US005209254A

United States Patent [19]

Ancselovics

[11] Patent Number: 5,209,254

[45] Date of Patent: May 11, 1993

[54] WATER AND SEWERAGE SYSTEM FOR CONSTRUCTION, AND PROTECTION FOR THE SAME

[76] Inventor: Slomo Ancselovics, 1628 E. 23 St., Brooklyn, N.Y. 11229

[21] Appl. No.: 784,561

[22] Filed: Oct. 29, 1991

[51] Int. Cl.[5] ..... E03B 7/00

[52] U.S. Cl. ..... 137/87; 137/357; 137/412

[58] Field of Search ..... 137/87, 362, 357, 412

[56] References Cited

U.S. PATENT DOCUMENTS

| | | | |
|---|---|---|---|
| 2,292,648 | 8/1942 | Moore | 137/412 X |
| 2,885,879 | 5/1959 | Bloom | 137/412 X |
| 4,607,399 | 8/1986 | Yovanofski | 137/412 X |
| 5,004,014 | 4/1991 | Bender | 137/486 |

*Primary Examiner*—Alan Cohan
*Attorney, Agent, or Firm*—Ilya Zborovsky

[57] ABSTRACT

A water and sewerage system for a construction, has at least one water consumer, at least one water supply pipe adapted to supply water from a water source to the water consumer, at least one water drainage pipe adapted to drain water from said consumer to a sewage reservoir and the like, a water level sensor cooperating with the water drainage pipe so as to sense when water reaches a predetermined level in the water drainage pipe, and at least one water supply interrupting element cooperating with the water supply pipe and connected with the water level sensor so that when water in the water drainage pipe reaches the predetermined level the sensor sends a signal to the water supply interrupting element and the water supply interrupting element interrupts water supply in the water supply pipe.

8 Claims, 2 Drawing Sheets

WATER AND SEWERAGE SYSTEM FOR CONSTRUCTION, AND PROTECTION FOR THE SAME

BACKGROUND OF THE INVENTION

The present invention relates to a water and sewerage system for a construction such as residential constructions, industrial constructions, etc., as well as to protection for the same.

Water and sewerage systems are well known and generally include a plurality of water supplying pipes extending from a main water supply pipe to respective consumers in a construction, and a plurality of water draining pipes leading to a sewage reservoir and the like. When a sewage reservoir is filled up or clogged there is a danger that water supplied into the system will over flow the system and emerge through water outlets with subsequent overflowing the construction. It is therefore desirable to develop such a system which prevents overflowing.

SUMMARY OF THE INVENTION

Accordingly, it is an object of the present invention to provide a water and sewerage system which avoids the disadvantages of the prior art.

More particularly, it is an object of the present invention to provide a water and sewerage system in which overflow of the system is reliably prevented.

In keeping with these objects and with others which will become apparent hereinafter, one feature of the present invention resides, briefly stated, in a water and sewerage system for a construction which has at least one water supplying pipe leading from a water source to a water consumer, at least one water draining pipe leading from the water consumer to a sewage reservoir and the like, a sensor associated with the water drainage pipe and operative for sensing water in the draining pipe at a predetermined level, and a water interrupting element associated with said water supplying pipe and connected with said sensor so that when the water in said draining pipe reaches a predetermined level said sensor produces a signal supplied to said water interrupting element so that said water supply pipe is closed and no water can be supplied into the system.

When the system is designed in accordance with the present invention, its overflow is reliably prevented since when the water or sewage reaches a predetermined level in the draining pipe, the supply of water into the system is cut off.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
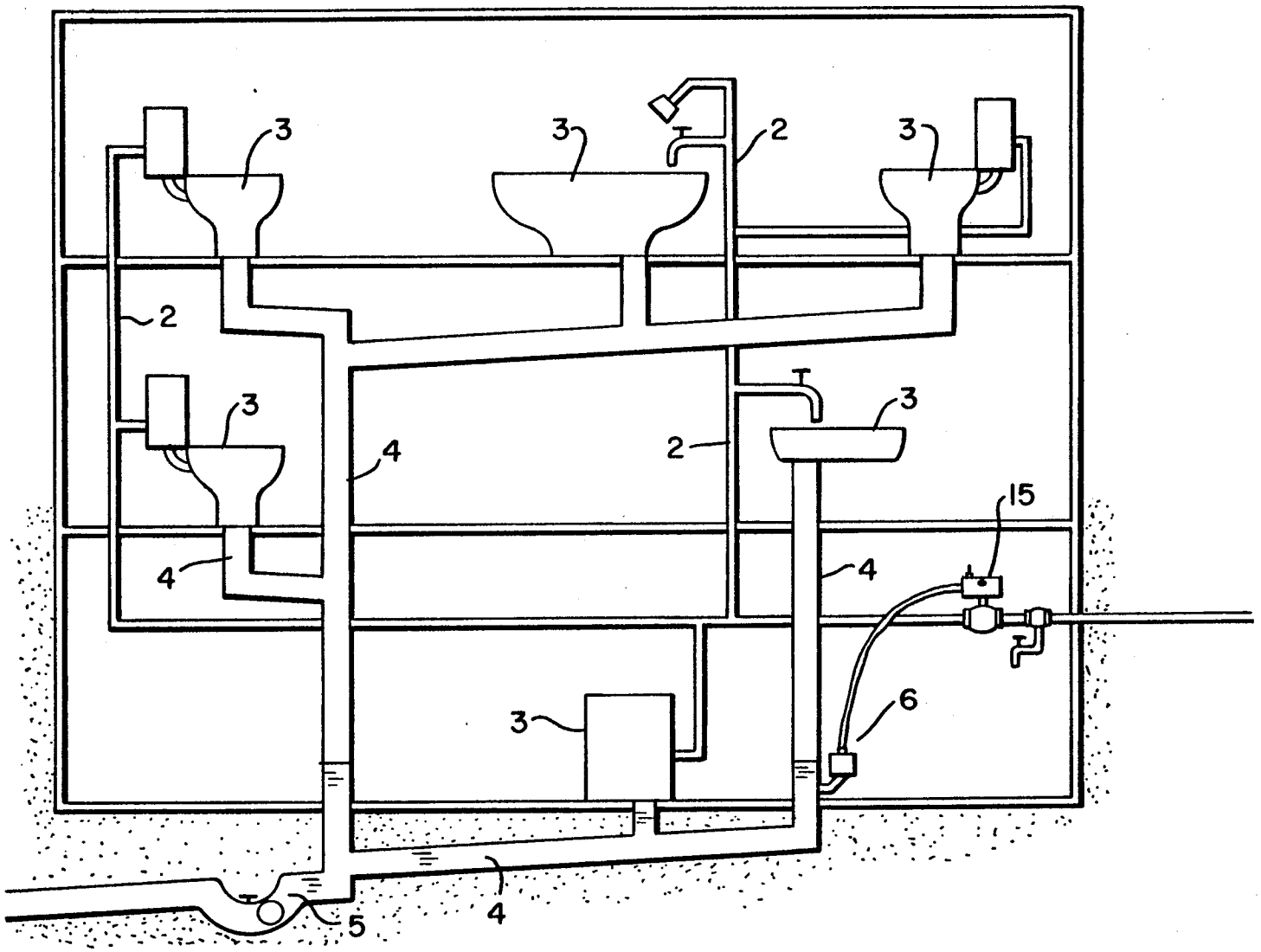
FIG. 1 is a view schematically showing a water and sewerage system in accordance with the present invention.
Figure 2:
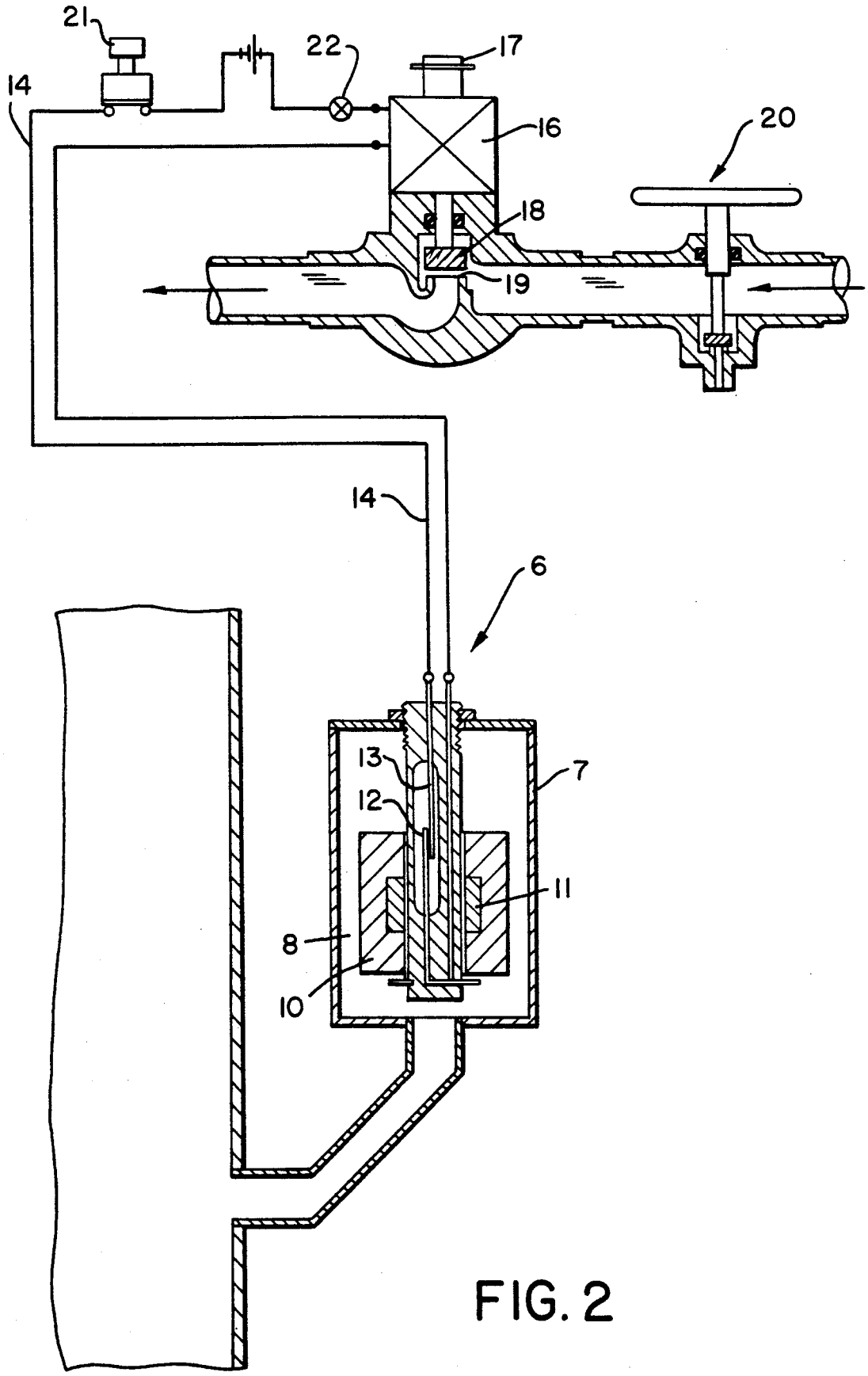
FIG. 2 is a view schematically showing a protecting device in accordance with the present invention for the inventive system.

A water and sewerage system for a construction, for example for a residential house has a main water supply pipe which is identified as a whole with reference numeral 1 and leads from a water source into the house. A plurality of water supplying pipes 2 extend from the main water pipe 1 and lead to a plurality of consumers which is identified as a whole with reference numeral 3. Draining pipes 4 extend from the consumers 3 to a main drainage pipe 5 which in turn leads to a sewage reservoir or the like, not shown in the drawings. In normal operation of the water and sewerage system water is supplied through the main water pipe 1 into the water supplying pipe 2 to the consumers 3. Upon actuating of a respective faucet, each individual consumer can consume water, such as for example for a sink, for a dishwasher, for a toilet, etc.

In accordance with the present invention a sensor 6 is connected with one of the water draining pipes 4 at a predetermined level. The level at which the sensor 6 is connected with the draining pipe 4 is locate preferably below the level of all consumers as shown in FIG. 1. The sensor 6 can include a housing 7 with an inner chamber 8 communicating with the draining pipe 4 through a connecting pipe 9. A float 10 provided with magnet member 11 which is arranged on a vertical holder displaceably in the housing 7 under the action of water which fills the inner chambers 8 of the housing. The electrical contacts 12 and 13 are arranged immovably in the above mentioned holder which is vertically arranged in the housing. When there is no water in the chamber 8, the float 10 is located in its lower position and the contacts 12 and 13 are not closed. When, however, water fills the inner chamber 8 of the housing 7 the float raises upwardly, the contacts 12 and 13 are attracted to and contact one another and a signal is produced in a circuit 14. A water interrupting device 15 is associated with the main water line 1. The water interrupting device has a normally open solenoid valve provided with a solenoid 16 and a plunger 17 movable vertically inside the solenoid. The solenoid valve is connected with a source of electric current. The plunger 17 has a valve member 18 which cooperates with a seat 19 formed in the main pipe 1. When the above mentioned electrical signal is produced by the sensor 6 and supplied to the solenoid valve 15, the solenoid 16 is energized, the plunger 18 is moved downwardly and the valve member 18 abuts against the valve seat 19 so as to close the main water pipe 1. The supply of water from the main water pipe 1 to the water supplying pipes 2 is therefore interrupted. In other words when a water level or sewage level in the draining pipes reaches a predetermined dangerous level, no more water can be supplied into the water and sewerage system in accordance with the present invention.

An emergency faucet 20 is located upstream of the water interrupting device 15. When the water supply into the system is closed, the emergency faucet can be opened by a user so that some water can still be received for emergency purposes. A resident of the house can open the faucet 20 and receive some water in a bucket or another reservoir to use as an emergency measure. For this purpose the user must come to the area where the main water pipe 1 is located which is usually in a basement of the house. The system in accordance with the present invention is also provided with an emergency switch 21 which is connected with the solenoid. When the water supply to the system is closed as described hereinabove, the user can actuate the emergency switch 21, electric current is supplied to the solenoid valve, the solenoid is energized and the plunger moves upwardly so as to open the main water pipe 1. As a result, water can be supplied to one or several consumers 3 in the house, when desired, for short periods of time. It is not necessary to come to the basement for using the emergency faucet, but instead water can be received in any desired consumer unit in the house.

When the water and sewerage system is designed in accordance with the present invention, its overflow is reliably prevented.

It will be understood that each of the elements described above, or two or more together, may also find a useful application in other types of constructions differing from the types described above.

While the invention has been illustrated and described as embodied in a water and sewerage system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt is for various applications without omitting features that, from the standpoint of prior art, fairly constitute essential characteristics of the generic or specific aspects of this invention.

What is claimed as new and desired to be protected by Letters Patent is set forth in the appended claims:

1. A water and sewerage system for a construction, comprising a plurality of water consumers; a water supply pipe adapted to supply water from a water source; a plurality of water supplying pipes extending from said water supply pipe to said water consumers; at least one water drainage pipe adapted to drain water to a sewage reservoir or the like; a plurality of water draining pipes extending from said water consumers to said water drainage pipe; a water level sensor connected with one of said water draining pipes so as to sense when water reaches a predetermined level in said one water draining pipe; and at least one water supply interrupting element cooperating with said water supply pipe so that when water in said one water draining pipe reaches said predetermined level said sensor sends a signal to said water supply interrupting element, and said water supply interrupting element interrupts water supply in said water supply pipe.

2. A water and sewerage system for a construction, comprising a plurality of water consumers; at least one water supply pipe adapted to supply water from a water source; a plurality of water supplying pipes extending from said water supply pipe to said water consumers; at least one water drainage pipe; a plurality of water draining pipes extending from said water consumers to said water drainage pipe; a water level sensor connected with said water drainage pipe so as to sense when water reaches a predetermined level in said water drainage pipe; and at least one water supply interrupting element cooperating with said water supply pipe and connected with said water level sensor so that when water in said water drainage pipe reaches said predetermined level said sensor sends a signal to said water supply interrupting element and said water supply interrupting element interrupts water supply in said water supply pipe.

3. A water and sewerage system, comprising a plurality of water consumers; a water supply pipe adapted to supply water from a water source; a plurality of water supplying pipes extending from said water supply pipe to said water consumers; at least one water drainage pipe adapted to drain water to a sewage reservoir and the like; a plurality of water draining pipes extending from said water consumers to said water drainage pipe; a water level sensor cooperating with said water drainage pipe so as to sense when water reaches a predetermined level in said water drainage pipe; and at least one water supply interrupting element connected with said water supply pipe and also connected with said water level sensor so that when water in said water drainage pipe reaches said predetermined level said sensor sends a signal to said water supply interrupting element and said water supply interrupting element interrupts water supply in said water supply pipe.

4. A water and sewerage system as defined in claim 3, wherein said water sensor has a housing communicating with said water drainage pipe, and a removable contact arranged in said housing, and a float provided with a removable contact so that when said housing is filled with water from said water drainage pipe said float raises and said contacts are closed so as to produce a signal indicating that said water drainage pipe reaches said predetermined level.

5. A water and sewerage system as defined in claim 4, wherein said water supply interrupting element includes an electromagnetic valve with a solenoid, a plunger vertically movable in said solenoid and provided with a valve member, and a seat formed in said water supply pipe, so that when said signal is produced by said water level sensor it is received by said electromagnetic valve, said solenoid is energized and lowers said plunger with said valve so that said valve member abuts against said valve seat and closes said water supply pipe.

6. A water and sewerage system as defined in claim 3, and further comprising a faucet arranged in said water supply pipe upstream of said water supply interrupting element so that when said water supply interrupting element interrupts water supply into the system, said faucet can be opened and some water can be received by a user from said water supply pipe upstream of said water supply interrupting element.

7. A water and sewerage system as defined in claim 3, and further comprising an emergency element actuatable by a user and activating said water supply interrupting element so that even when water reached said predetermined level in said water drainage pipe said water supply interrupting element can be opened by said emergency element and water can be supplied from said water supply pipe to said consumer when desired.

8. A water and sewerage system as defined in claim 5, and further comprising an emergency element actuatable by a user and activating said water supply interrupting element so that even when water reached said predetermined level in said water drainage pipe said water supply interrupting element can be opened by said emergency element and water can be supplied from said water supply pipe to said consumer when desired, said emergency element being electrically connected with said solenoid so as to energize said solenoid and therefore to raise said plunger so that said valve member is withdrawn from said valve seat and water can be supplied through said water supply pipe.

* * * * *